US011719074B2

(12) United States Patent
Chen et al.

(10) Patent No.: US 11,719,074 B2
(45) Date of Patent: Aug. 8, 2023

(54) DISSOLVABLE PLUGGED NOZZLE ASSEMBLY FOR LIMITED ENTRY LINERS

(71) Applicant: WellNoz, Houston, TX (US)

(72) Inventors: Ting Chen, Missouri City, TX (US); Indranil Roy, Missouri City, TX (US)

(73) Assignee: Damorphe, Inc., Houston, TX (US)

( * ) Notice: Subject to any disclaimer, the term of this patent is extended or adjusted under 35 U.S.C. 154(b) by 0 days.

(21) Appl. No.: 17/010,804

(22) Filed: Sep. 2, 2020

(65) Prior Publication Data

US 2021/0317727 A1 Oct. 14, 2021

Related U.S. Application Data

(63) Continuation of application No. 16/847,548, filed on Apr. 13, 2020, now abandoned.

(51) Int. Cl.
*E21B 41/00* (2006.01)
*E21B 33/13* (2006.01)

(52) U.S. Cl.
CPC ..... *E21B 41/0078* (2013.01); *E21B 33/13* (2013.01); *E21B 2200/08* (2020.05)

(58) Field of Classification Search
CPC ... E21B 41/0078; E21B 2200/08; E21B 43/12
See application file for complete search history.

(56) References Cited

U.S. PATENT DOCUMENTS 4,341,273 A * 7/1982 Walker ..... E21B 27/005 175/312
4,391,339 A * 7/1983 Johnson, Jr. ..... E21B 10/60 239/589
6,585,063 B2 * 7/2003 Larsen ..... E21B 10/61 175/57

* cited by examiner

*Primary Examiner* — Robert E Fuller
(74) *Attorney, Agent, or Firm* — David Groesbeck

(57) ABSTRACT

A nozzle for use with a limited entry liner. A limited entry liner can house multiple nozzles and each nozzle can include a barrel and a central, dissolvable region. The dissolvable region is made of a material that has specific properties that allow the central region to withstand pressure and environment in a well up to a certain, known point at which time the central portion will dissolve and allow fluid to pass into the limited entry liner.

17 Claims, 5 Drawing Sheets

DISSOLVABLE PLUGGED NOZZLE ASSEMBLY FOR LIMITED ENTRY LINERS

CROSS-REFERENCE TO RELATED APPLICATIONS

This application claims priority to U.S. patent application Ser. No. 16/847,548 filed Apr. 13, 2020 entitled "DISSOLVABLE PLUGGED NOZZLE ASSEMBLY FOR LIMITED ENTRY LINERS" which is incorporated herein by reference in its entirety.

BACKGROUND

Many well operations in both production and injection wells use cement to seal portions of the well. Delivering the cement to the right location in the well without fouling other portions of the well is an important objective. Many such wells are cemented using liner hangers, sleeves, and screens to deliver the cement to the appropriate place, and the sleeves are used to prevent the cement from entering the screen. Once the cement is in place above and/or below a zone of interest, a perforated sleeve is used to allow fluids to be injected into the formation or to allow fluids to flow from the formation such as during production. The perforated sleeve has a plurality of holes that are filled with nozzles. The nozzles currently available in the market are unable to meet the needs of the developing market to perform as required in harsh conditions with superior performance. There is accordingly a need for nozzles having improved characteristics.

SUMMARY

Embodiments of the present disclosure are directed to a dissolvable plugged nozzle assembly ("DPNA") for injection of fluids into a well for use with limited entry liners. The DPNA includes a barrel having a cylindrical outer surface configured to facilitate mounting within a hole in a cylindrical limited entry liner, an interior face facing inward relative to the limited entry liner, and an exterior face opposite the interior face. The barrel also has a sinuous interior profile defining an orifice through the barrel. The sinuous interior profile includes a lipped opening in the interior face, a concave region adjacent to the lipped opening, a shoulder region adjacent to the concave region, a convex region adjacent to the shoulder region, and a flared opening in the exterior face and adjacent to the convex region. The DPNA also includes a core formed in the barrel and having a complementary shape to the sinuous interior profile of the barrel, wherein the core is dissolvable.

DETAILED DESCRIPTION

Figure 1:
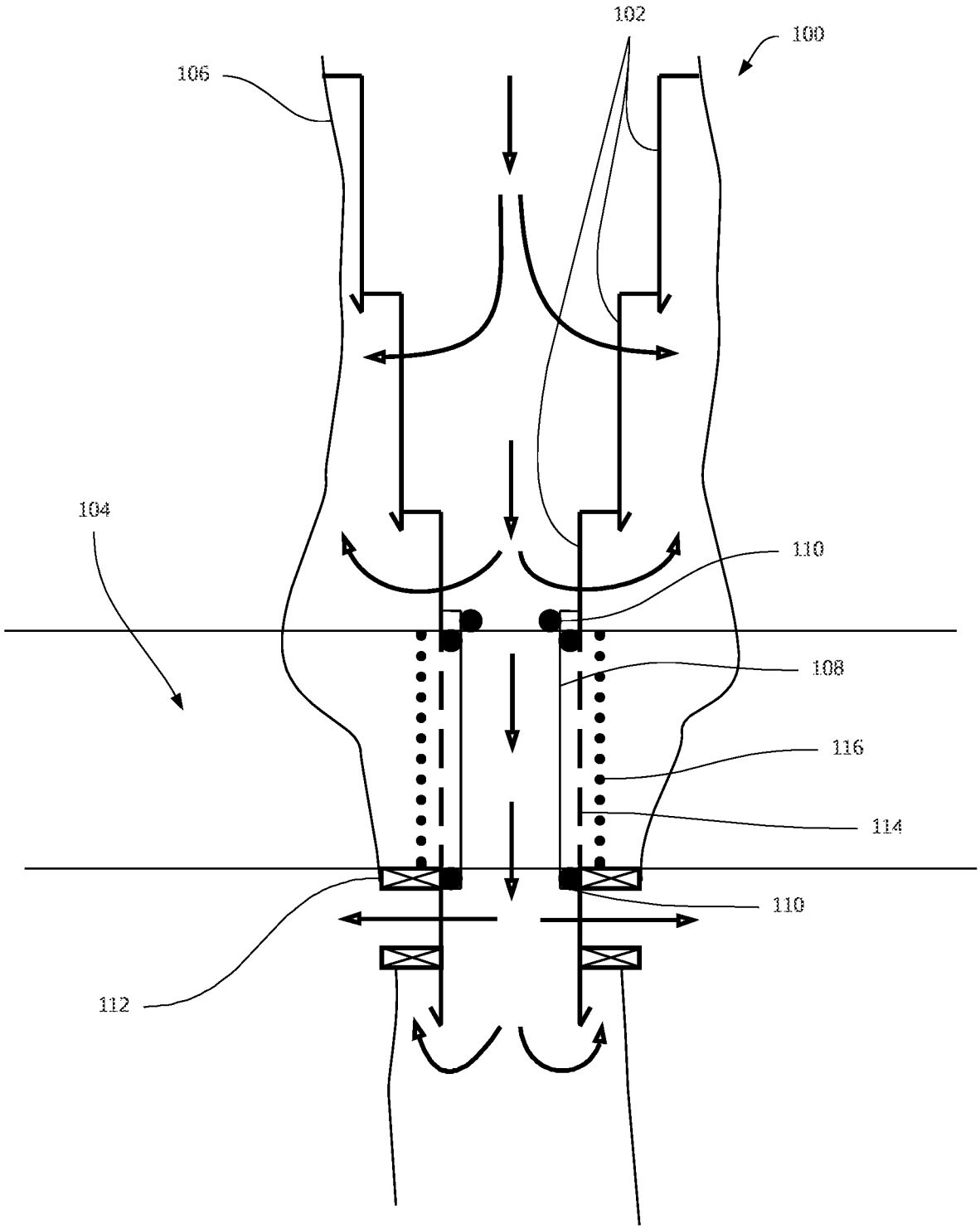
Figure 1 (Prior art)
FIG. 1 is a cross-sectional illustration of a well that has been cemented and is being prepared to undergo an injection procedure according to the prior art.

FIG. 1 is a cross-sectional illustration of a well 100 that has been cemented and is being prepared to undergo an injection procedure according to the prior art. The well 100 has liner hangers 102 installed above a zone of interest 104. Cement can be delivered into the well 100 underneath the liner hangers 102 such that the cement fills the space between the liner hangers 102 and the open hole surface 106. The zone of interest 104 can be at any depth in the well 100 and can be in an injection well or a production well. There can be many zones of interest 104 in a given well and the techniques, systems, and methods described herein with reference to the single zone of interest 104 in this well 100 can be applied to any other zone of interest in the well 100.

At the zone of interest 104 a sleeve 108 can be installed with seals 110 at an upper and lower locations to seal the sleeve to the liner hanger 102 such that cement can be delivered to a region below the zone of interest 104. Packers 112 can be installed below or above the zone of interest 104. There can be multiple packers 112 defining an injection zone between them as desired. Also in the zone of interest 104 there can be a perforated liner 114 that is a generally cylindrical member having holes through which fluid will pass in either production or injection. The perforated liner can also be referred to as a limited entry liner. A screen 116 can be installed around the perforated liner 114. The screen 116 can be inside the liner 114, or there can be multiple screens inside or outside the liner 114.

Figure 2:
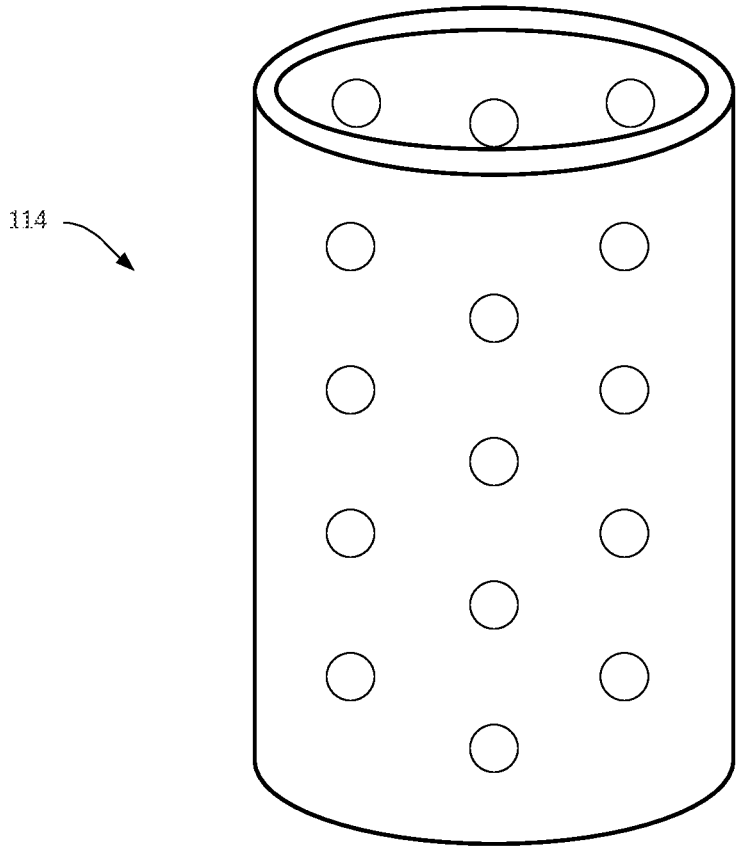
FIG. 2 is an illustration of a perforated liner according to embodiments of the present disclosure.

FIG. 2 is an illustration of a perforated liner 114 according to embodiments of the present disclosure. The size and pattern of the holes can vary for a given application. Once the cement is in place, the sleeve 108 can be removed either by pulling it out of the well or by pushing it further downhole or by any other suitable method. With the screen out of the way, the zone of interest 104 can be accessed for injection or production.

Figure 3:
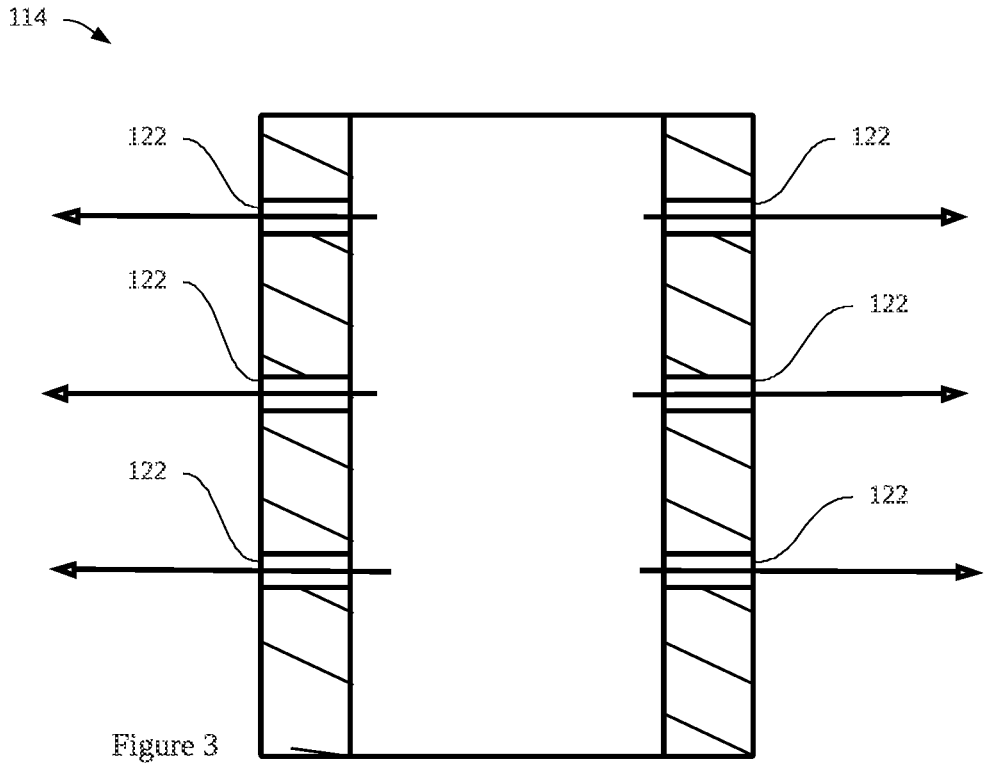
FIG. 3 is a schematic cross-sectional view of a perforated liner including a dissolvable plugged nozzle assembly (DPNA) according to embodiments of the present disclosure.

FIG. 3 is a schematic cross-sectional view of a perforated liner 114 including a dissolvable plugged nozzle assembly (DPNA) 122 according to embodiments of the present disclosure. The DPNA 122 can include a nozzle and can be referred to herein as a nozzle or a DPNA interchangeably. The liner 114 is generally cylindrical. Some or all of the perforations are filled with nozzles 122. In some embodiments there are nozzles in each hole in the liner. In other embodiments there are some holes that are left empty, some holes that have one kind of nozzle and other holes have other nozzles. In yet other embodiments some of the holes are filled with blanks to block passage of fluid. In embodiments of the present disclosure the nozzles 122 are strong enough to withstand a differential pressure up to 10,000 psi. The pressure can be higher on the interior or on the exterior. In some embodiments the nozzles are bi-directionally capable of withstanding a high pressure from either direction. In some embodiments the nozzles are made of a dissolvable material that will dissolve under certain specific conditions after a certain time has passed. The nozzles 122 therefore are capable of preventing flow through the nozzles until a desired time and/or condition is achieved, during which time a high pressure can be held from either direction, and after the desired time the nozzles can commence allowing fluid to flow into or out of the liner 114.

Figure 4:
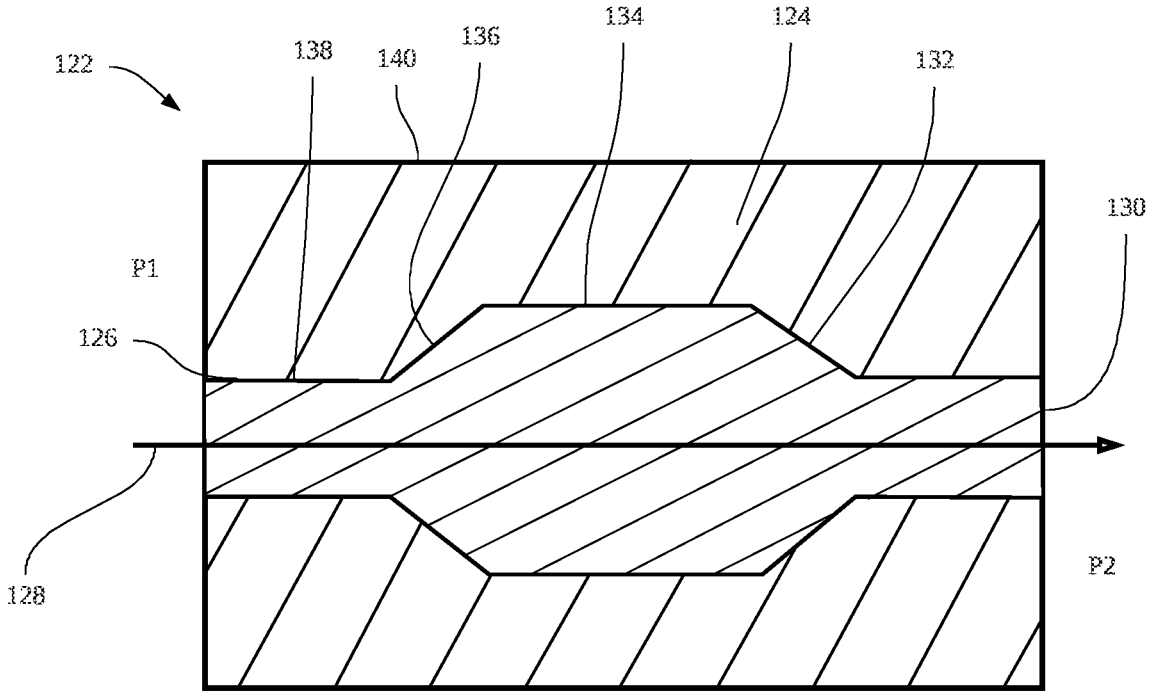
FIG. 4 is a schematic cross-sectional view of a DPNA according to embodiments of the present disclosure.

FIG. 4 is a schematic cross-sectional view of a DPNA 122 according to embodiments of the present disclosure. For purposes of explanation and not limitation, the DPNA 122 shown is positioned in a liner (not shown) that is oriented vertically with the nozzle 122 on the right-hand side of the liner. The right-hand side of FIG. 4 is outside the liner and pressure from this side is shown as P2. The left-hand side of FIG. 4 is the inside of the liner and pressure from this side is shown as P1. The cross-section of the view is in the center of the DPNA 122. The DPNA 122 has a barrel 124 and a core 126. The barrel 124 and the core 126 together form a solid mass of material with no space or air between them. The DPNA has a central axis 128. The radius of the core 126 varies along the length of the DPNA 122. The right-hand side of the DPNA 122 faces outside the liner in which the DPNA 122 is mounted. Beginning on the right and moving toward the left, in an inward direction, the radii of the core 126 are as follows: a first radius 130, a first transition region 132, a second radius 134, a second transition region 136, and a third radius 138. The first and third radii can be the same. The second radius 134 is larger than the first and second radii. The transition regions 132 and 136 can be sloped or they can be vertical. The shape of the barrel 124 complements the center portion. The outer surface 140 can be cylindrical to fit into the holes in the liner if the holes are cylindrical or another shape according to the shape of the holes in the liner. The outer surface 140 can be threaded or otherwise adapted to facilitate mounting within the liner.

In some embodiments of the present disclosure the core 126 is made of a dissolvable material and the radially outward portion 124 is not. When subject to an environment that has the properties necessary to dissolve the material, and after sufficient time in such environment, the core 126 begins to dissolve. Once the material dissolves sufficiently it will begin to allow fluid to pass through the DPNA 122. The timing of the dissolution can be selected by tailoring the properties of the core 126 and knowing the properties of the well environment.

Figure 5:
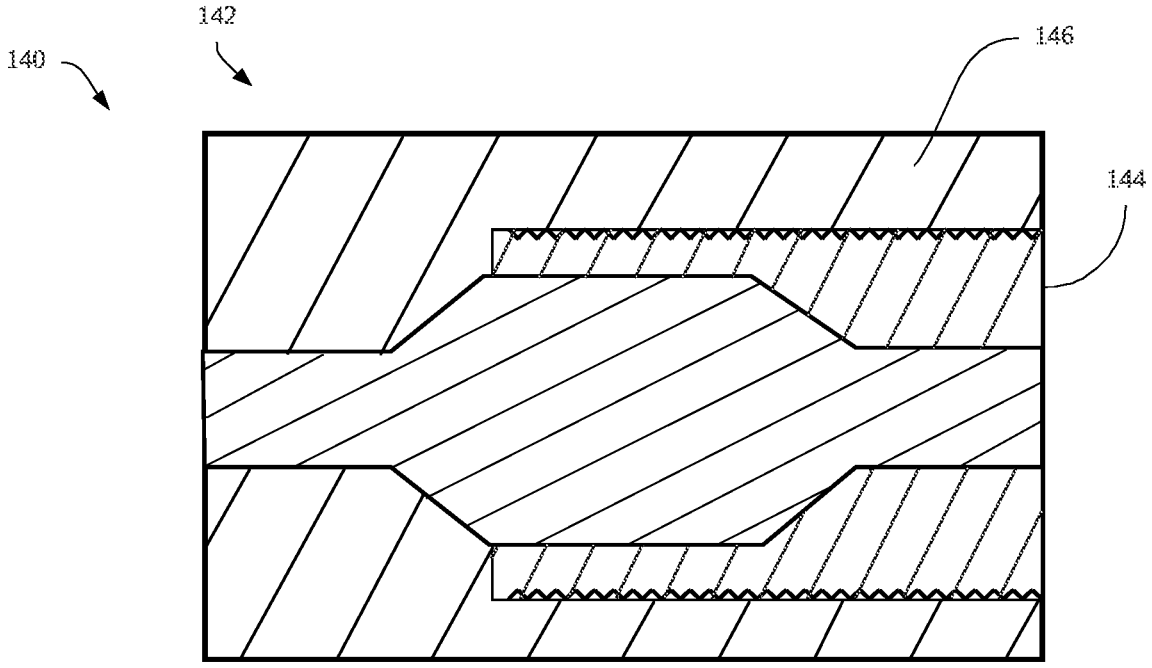
FIG. 5 is another schematic cross-sectional view of a DPNA according to embodiments of the present disclosure.

FIG. 5 is another schematic cross-sectional view of a DPNA 140 according to embodiments of the present disclosure. The DPNA 140 can include a barrel 142 that is made of two components: a male component 144 having outwardly-facing threads and a female component 146 having inwardly-facing threads configured to engage with the outwardly-facing threads of the male component 144. The interior profile and outer shape of the DPNA 140 can be similar to the DPNA 122 shown and described with respect to FIG. 4. The two-part construction of the radially-outward portion 142 enables assembly and construction of the DPNA 140.

Figure 6:
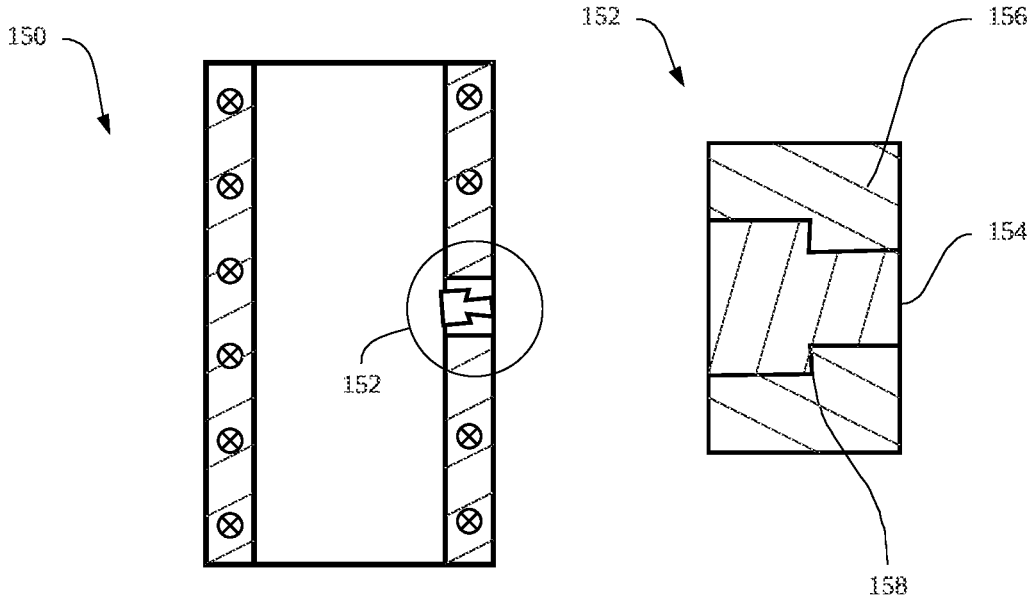
FIG. 6 is a schematic cross-sectional view of a limited entry liner with a closeup view of a DPNA according to embodiments of the present disclosure.

FIG. 6 is a schematic cross-sectional view of a limited entry liner 150 with a closeup view of a DPNA 152 according to embodiments of the present disclosure. The liner 150 is a cylindrical member having an inner diameter (ID) and an outer diameter (OD). The liner 150 has multiple holes spread throughout the liner facing in many directions. A single such hole is shown in detail holding the DPNA 152. Other hole sites are shown with an X. There can be many different patterns and sizes of holes and some or all of them can hold DPNAs. For purposes of brevity and clarity only a single DPNA is shown in detail.

In the shown embodiment the DPNA 152 is a uni-directional DPNA meaning that the DPNA will withstand greater pressure in one direction than in another direction. The DPNA 152 has a core 154 and a barrel 156. The radius of the core 154 is greater on the interior diameter ("ID") side, and a transition region 158, and a smaller radius region on the outer diameter ("OD") side. Pressure from the ID side urges the core 154 against the transition region 158, resulting in a greater ability to withstand pressure from the ID side to the OD side. The DPNA 152 is threadably coupled to the liner 150 so the DPNA 152 can withstand pressure from both sides; however, the shape of the core 154 grants the DPNA 152 greater pressure capabilities in one direction than in the other direction. Compare to the bi-directional DPNA shown in FIGS. 4 and 5 which have two transition regions.

In other embodiments there are many such uni-directional DPNAs and some or all of them can be directed inwardly, some or all of them can be directed outwardly, and in some embodiments there can be both inward and outward facing unidirectional DPNAs. In some embodiments there can be some uni-directional DPNAs and some bi-directional DPNAs. There may be a combination of uni-directional inward, uni-directional outward, and bi-directional DPNAs.

Figure 7:
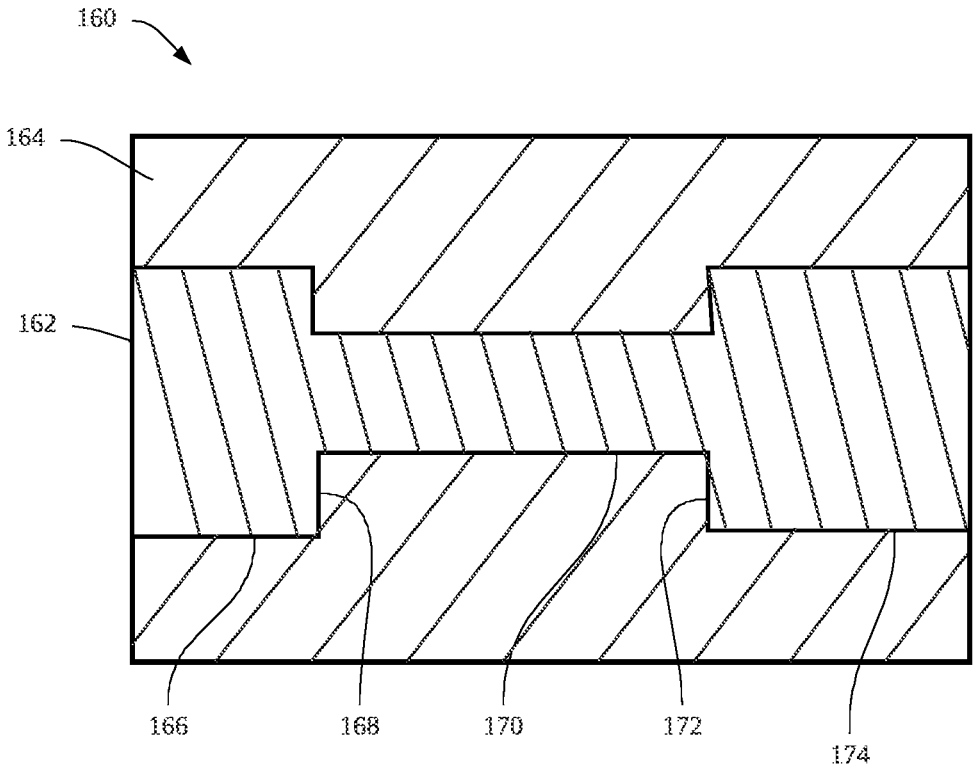
FIG. 7 is a schematic cross-sectional view of a DPNA nozzle according to further embodiments of the present disclosure.

FIG. 7 is a schematic cross-sectional view of a DPNA 160 according to further embodiments of the present disclosure. The DPNA 160 has a core 162 and a barrel 164. The central portion 162 can have a first radius 166, a transition region 168, a second radius 170, a transition region 172, and a third radius 174. The second radius is smaller than the first and third radius, and the transition regions cause this DPNA to be bi-directional. The first and third radii can be the same, resulting in a pressure rating being substantially equal in both directions. In other embodiments the first and third radii can be different, resulting in a bi-directional DPNA that has greater pressure withstanding capabilities in one direction than in another. The relative size of the radii determines, in part, the pressure capabilities of the DPNA.

In other embodiments there can be more than three radii of the DPNA. Some DPNAs have stepped, monotonic radii gradations while others have a large-small-large configuration like that pictured in FIG. 7, or a small-large-small configuration pictured in FIGS. 4 and 5. Combinations thereof are also possible within the scope of the present disclosure.

The DPNAs shown and described herein can be specifically designed to achieve certain results in a given well environment. For example, a set of DPNAs can be designed to achieve a three-stage process such as the following. In stage one, the DPNAs can be designed to withstand pressure from the ID side of approximately 500 psi for 10 days in reservoir drilling fluid, otherwise known as non-aqueous fluid or RDFNAF. In stage two, the DPNAs can be designed to withstand pressure from the ID to the OD of approximately 3000 psi for at least 36 hours in brine. In some embodiments the DPNAs can withstand pressure of up to 5,000 psi. In stage three the DPNAs can be designed to dissolve in less than 14 days while subject to pressure from the OD to the ID of approximately 500 psi while still in the brine. The brine can be any of the following:

1. 1.05 SG NaCl formulation: 8% by weight NaCl in freshwater;
2. 1.25 SG NaCl/NaBr formulation: 21% by weight NaCl and 9% by weight NaBr in freshwater;
3. 1.49 SG NaCl/NaBr formulation: 1% by weight NaCl and 43% by weight NaBr in freshwater.

The dissolvable material may be one of the following (a) brine insensitive metallic alloy, (b) partially or fully vitrified metal (p-BMG) or matrix composite (BMGCG), (c) metal integrated polymer composites or vice versa. The relative percentages of each component can be varied to achieve a desired dissolution rate. The environment to which the material is exposed to dissolve it also affects the dissolution rate. For the three brines listed above, the dissolution rates can be as follows:

1. 1.05 SG NaCl formulation: 8% by weight NaCl in freshwater; dissolution rate range: 50-250 MCD;
2. 1.25 SG NaCl/NaBr formulation: 21% by weight NaCl and 9% by weight NaBr in freshwater; dissolution rate range: 50-250 MCD;
3. 1.49 SG NaCl/NaBr formulation: 1% by weight NaCl and 43% by weight NaBr in freshwater; dissolution rate range: 50-250 MCD.

The exposed temperature is between 100-225 degrees F. (MCD is millimeters centimeters squared per day.)

The volume percentage of the component materials determines, at least in part, where in the rate range the material will fall. Accordingly, a variety of downhole conditions can be addressed such that the DPNAs will hold for a certain, predictable period of time after which the DPNAs will dissolve and allow fluid to pass through them into or out of the limited entry liner.

Figure 8:
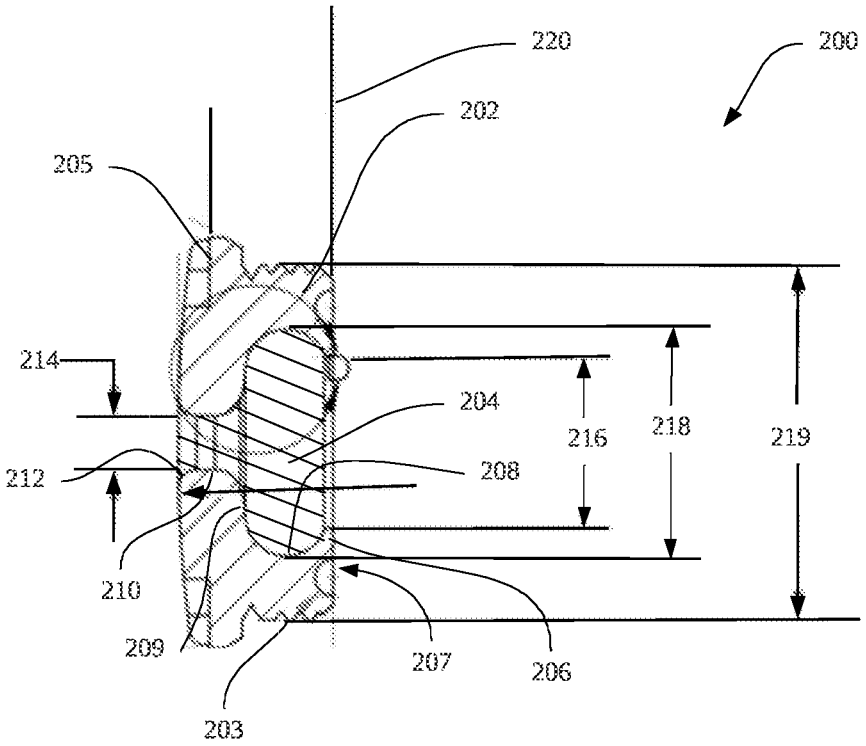
FIG. 8 is a schematic cross-sectional view of a DPNA nozzle according to further embodiments of the present disclosure.

FIG. 8 is a DPNA 200 according to further embodiments of the present disclosure. The DPNA 200 is for use with a liner similar to other DPNAs disclosed and shown herein. The DPNA includes a barrel 202 and a core 204 that are complementary with the core 204 being positioned within the barrel 202. The barrel 202 has a threadable surface 203 that facilitates placement in the liner. The threadable surface 203 has a circumference defined at 219. The barrel 202 also has a cap region 205 that is wider than the threadable surface 203 and protrudes from the liner slightly. The core 204 is made of a dissolvable material that will dissolve under certain environmental conditions in a well and after being in position in that environment for a predetermined time.

The shape of the interface between the core 204 and barrel 202 is sinuous. Beginning at a left-hand side of the DPNA 200 shown in FIG. 8, which represents an interior side of the liner in which the DPNA 200 is deployed, the barrel 202 is generally flat on the interior side 207. The barrel 202 defines a lipped opening 206 followed by a concave region 208. In some embodiments the concave region has a constant radius and is approximately a semicircle in cross-section. Next is a shoulder region 209 that narrows the barrel from the concave region 208. In some embodiments the shoulder region 209 is parallel with the interior side 207. Following the shoulder region 209 is a convex region 210 which continues through the DPNA 200 and reaches the exterior side. The convex region 210 includes a flared opening 212. Accordingly, the barrel 202 has a sinuous interior profile. Dimension 214 represents a diameter of an opening on the left-hand side of the DPNA 200. Dimension 216 represents a diameter of an opening on the right-hand side of the DPNA 200. Dimension 218 represents a widest radial dimension of the concave region 208 of the DPNA 200.

The concave region 208 has a larger radius than the convex region 210. In some embodiments the concave region 208 is approximately three times larger than the convex region 210. In some embodiments the lipped opening 206 is approximately three times the narrowest dimension of the convex region 210. The axial length of the concave region 208 is approximately equal to the axial length of the convex region 210, wherein the axial length is defined along a central axis that is horizontal in FIG. 8 and aligned with the core 204. In some embodiments the concave region 208 has a uniform radius. In some embodiments the convex region 210 also has a uniform radius. In some embodiments the lipped opening 206 is 0.375 inches in diameter and the convex region 210 is 0.118 inches in diameter.

The core 204 has a corresponding, complementary shape and fills up the interior of the barrel 202. To manufacture the DPNA 200, first the barrel 202 can be formed using a mold or by machining. The barrel 202 can be made of a dissolvable material. Then, the dissolvable material can be formed inside the barrel 202 by cold isostatic pressing ("CIP") and sintering the dissolvable material inside the barrel 202. The dissolvable material is first introduced into the barrel 202 as a powder, and as a result of the CIP and sintering process results in a hardened, solid, rigid core 204.

The sinuous shape of the barrel 202 allows the DPNA 200 to operate as a venturi nozzle once the core 204 has dissolved. The DPNA 200 in its ultimate form is the barrel 202 without the core 204, and the barrel 202 operates as a nozzle. The DPNA 200 in this ultimate form can withstand differential pressures of over 2600 psi (defined as pressure between the interior and exterior of the liner, through the DPNA 200) and a flow rate of 0.5 barrels per minute ("bpm"). For a liner having one hundred such DPNAs installed around its surface (refer to FIG. 2), the combined flow rate is 60 bpm.

Further aspects of the present disclosure will become apparent from the Figures and the appended claims.

The invention claimed is:

1. A dissolvable plugged nozzle assembly (DPNA) for injection of fluids into a well for use with limited entry liners, the DPNA comprising:

a barrel having:

a cylindrical outer surface configured to facilitate mounting within a hole in a cylindrical limited entry liner;

an interior face facing inward relative to the limited entry liner;

an exterior face opposite the interior face;

a sinuous interior profile defining an orifice through the barrel, the sinuous interior profile comprising a lipped opening in the interior face, a concave region adjacent to the lipped opening, a shoulder region adjacent to the concave region, a convex region adjacent to the shoulder region, and a flared opening in the exterior face and adjacent to the convex region; and a core formed in the barrel and having a complementary shape to the sinuous interior profile of the barrel, wherein the core is dissolvable, wherein the DPNA can withstand a fluid pressure differential of at least 2,500 psi with the core intact.

2. The dissolvable plugged nozzle assembly of claim 1 wherein the core is made of a metallic material.

3. The DPNA of claim 1 wherein the core is made of a bulk metallic glass material.

4. The DPNA of claim 1 wherein the core is made from at least one of metallic alloy, partially vitrified metal, fully vitrified metal, or a metal integrated polymer composite.

5. The DPNA of claim 1 wherein after the core dissolves the barrel can withstand a differential pressure of at least 2600 psi and a flow rate through the barrel of at least 0.6 bpm.

6. The DPNA of claim 1 wherein the concave region is at least three times wider than the convex region.

7. The DPNA of claim 1 wherein the barrel can withstand a differential pressure of at least 2000 psi and a flow rate through the barrel of at least 0.5 bpm.

8. The DPNA of claim 1 wherein the core dissolves after 36 hours.

9. The DPNA of claim 1 wherein the sinuous interior profile is symmetric about a central axis through the DPNA.

10. The DPNA of claim 1 wherein the DPNA has a length in a direction aligned with the barrel and a width perpendicular to the barrel, wherein the thickness is less than the width.

11. A dissolvable plugged nozzle assembly (DPNA), comprising:

a perforated liner having generally cylindrical tubular member having a plurality of holes oriented radially at a plurality of axial locations and in a plurality of circumferential directions, thereby perforating the perforated liner;

one or more nozzles in one or more of the holes, the nozzles comprising:

a barrel having a generally cylindrical outer surface configured to engage with the holes in the perforated liner;

a sinuous interior profile being generally aligned with a hole in which the nozzles are located, wherein the sinuous interior profile is symmetrical about the central axis, the sinuous interior profile having a lipped opening, a concave region, a shoulder region, a convex region, and a flared opening opposite the lipped opening; and a core in the nozzle filling the barrel and matching the sinuous interior profile, the core being dissolvable and capable of withstanding pressures of at least 2,500 psi with the core and barrel intact before dissolution of the core begins.

12. The DPNA of claim 11 the core is made from at least one of metallic alloy, partially vitrified metal, fully vitrified metal, or a metal integrated polymer composite.

13. The DPNA of claim 11 wherein after the core dissolves the barrel can withstand a differential pressure of at least 2600 psi and a flow rate through the barrel of at least 0.6 bpm.

14. The DPNA of claim 11, further comprising a cap region that protrudes from the perforated liner when the DPNA is installed in the perforated liner.

15. The DPNA of claim 14 wherein the core is made from at least one of metallic alloy, partially vitrified metal, fully vitrified metal, or a metal integrated polymer composite.

16. The DPNA of claim 14 wherein the sinuous interior profile is generally continuous in shape.

17. A dissolvable plugged nozzle assembly (DPNA), comprising:

a barrel having:

a cylindrical exterior surface configured to be received into a hole in a limited entry liner;

a cap region being wider than the threadable exterior of the barrel;

a sinuous interior profile including a lipped interior opening, a concave region having a diameter larger than the lipped interior opening, a shoulder region, a convex region having a diameter smaller than the lipped interior opening, and a flared exterior opening, the sinuous interior profile being symmetrical about a central axis of the barrel;

a core in the barrel, the core being made of a dissolvable material, the core and barrel together being configured to withstand at least 2,500 psi with the core and barrel intact before the core begins to dissolve, the core filling the barrel from the flared opening to the lipped opening.

* * * * *